US009677804B2

(12) United States Patent
Resch

(10) Patent No.: US 9,677,804 B2
(45) Date of Patent: Jun. 13, 2017

(54) REFRIGERATING FURNITURE, IN PARTICULAR REFRIGERATING SHELF

(75) Inventor: Reinhold Resch, St. Peter (AT)

(73) Assignee: AHT COOLING SYSTEMS GMBH, Rottenmann (AT)

( * ) Notice: Subject to any disclaimer, the term of this patent is extended or adjusted under 35 U.S.C. 154(b) by 305 days.

(21) Appl. No.: 13/819,011

(22) PCT Filed: Aug. 26, 2011

(86) PCT No.: PCT/EP2011/004283
§ 371 (c)(1),
(2), (4) Date: Feb. 26, 2013

(87) PCT Pub. No.: WO2012/025240
PCT Pub. Date: Mar. 1, 2012

(65) Prior Publication Data

US 2013/0152623 A1 Jun. 20, 2013

(30) Foreign Application Priority Data

Aug. 27, 2010 (DE) ..... 10 2010 035 695

(51) Int. Cl.
*F25D 25/00* (2006.01)
*F25D 11/00* (2006.01)
(Continued)

(52) U.S. Cl.
CPC ..... *F25D 11/00* (2013.01); *A47F 3/0443* (2013.01); *A47F 3/0491* (2013.01);
(Continued)

(58) Field of Classification Search
CPC ..... A47F 3/0443; A47F 3/0491; A47F 3/04; F25B 2339/047; F25B 2400/06; F25D 11/00; F25D 23/003; F25D 23/006
(Continued)

(56) References Cited

U.S. PATENT DOCUMENTS 4,949,554 A * 8/1990 Branz et al. ..... 62/248
2004/0031280 A1* 2/2004 Martin ..... A47F 3/0482 62/246

(Continued)

FOREIGN PATENT DOCUMENTS

DE 19906742 A1 * 8/2000
EP 0 908 688 4/1999

(Continued)

OTHER PUBLICATIONS

International Search Report for PCT/EP2011/004283.

*Primary Examiner* — Len Tran
*Assistant Examiner* — Ana Vazquez
(74) *Attorney, Agent, or Firm* — Donald J. Ranft; Collen IP

(57) ABSTRACT

The invention relates to a refrigerating shelving unit, particularly a refrigerating shelf (KR1) for cooling and displaying products to be refrigerated in a cooling chamber (KR1M), including an access region via which the products to be refrigerated are accessible, and a refrigerating device (KR1KE) which includes a condenser (VF) and a compressor (KOM). According to the invention, it is provided that the condenser (VF) is arranged at least partially within the refrigerating shelf (KR1) and in the upper region (HR1) thereof and that the compressor (KOM) is arranged within the refrigerating shelf (KRI) in the lower region (VR) thereof. As a result, interfering noise emissions are reduced and, simultaneously, the packaging of the refrigerating shelving unit at the manufacturing site and the transport to the site of use are simplified.

19 Claims, 8 Drawing Sheets

Figure 1:
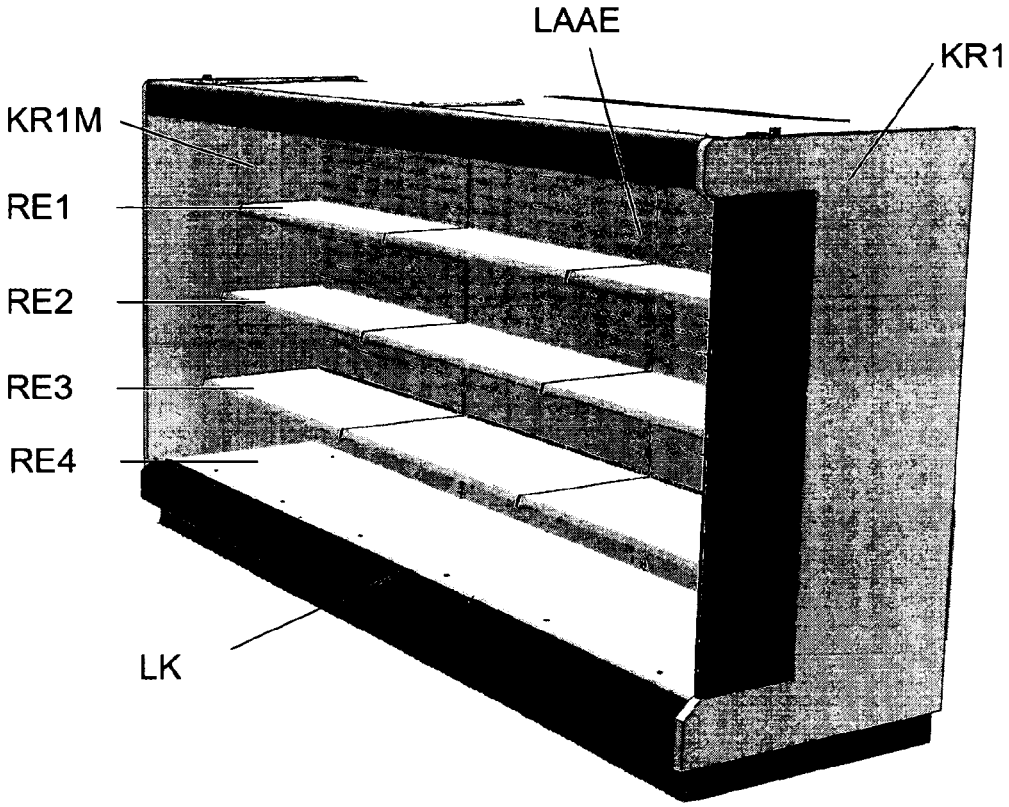

(51) Int. Cl.
*A47F 3/04* (2006.01)
*F25D 23/00* (2006.01)

(52) U.S. Cl.
CPC ..... *F25D 23/003* (2013.01); *F25B 2339/047* (2013.01); *F25B 2400/06* (2013.01)

(58) Field of Classification Search
USPC ..... 62/465, 407, 255, 449, 256, 450, 246, 62/252
See application file for complete search history.

(56) References Cited

U.S. PATENT DOCUMENTS

| | | | | |
|---|---|---|---|---|
| 2004/0194477 | A1* | 10/2004 | Gaudet | F04B 37/08 62/55.5 |
| 2005/0126196 | A1* | 6/2005 | Grassmuck | A47F 3/0482 62/251 |
| 2012/0125038 | A1* | 5/2012 | Oh | F25D 23/003 62/428 |

FOREIGN PATENT DOCUMENTS

| | | | |
|---|---|---|---|
| EP | 1 780 485 | A1 | 5/2007 |
| JP | 58-019678 | | 2/1983 |
| JP | 58019678 | A | 2/1983 |
| JP | 59-094275 | | 6/1984 |
| JP | 60-041787 | | 3/1985 |
| JP | 03-007871 | | 1/1991 |
| JP | 09-229535 | | 9/1997 |
| JP | 2002-130910 | | 5/2002 |
| JP | 2004-138356 | | 5/2004 |
| JP | 2005-114216 | | 4/2005 |
| JP | 2009-243768 | | 10/2009 |
| WO | 2006087007 | A1 | 8/2006 |

* cited by examiner

REFRIGERATING FURNITURE, IN PARTICULAR REFRIGERATING SHELF

The invention relates to a refrigerating shelving unit.

From DE 102 05 621 A1, DE 102 05 622 A1, DE 20 2004 013 901 U1, DE 20 2005 011 812 U1, DE 202 02 060 U1 and DE 201 19 300 U1 refrigerating shelving units for the presentation and refrigeration of goods are already known.

From DE 30 46 296 A1 a method and a device for improving the energy balance of refrigerating systems are known. For this purpose, the waste heat of the refrigerating assembly is discharged to the external air or to a service water preheater. A heat exchanger is connected in upstream of an air condenser of the refrigerating assembly and is connected to an external cooler and/or a radiator of a water reservoir via a secondary cooler circulation system.

From DE 297 23 977 U1 a domestic refrigerating apparatus with a storage space which can be cooled by a refrigerator is known, wherein the waste heat of the refrigerator is supplied to a service water tank to heat service water.

An arrangement of a plurality of refrigerating shelving units is also already known, wherein the refrigerating shelving units are connected to a central coldness supply device. In the case of the known arrangement, a refrigeration agent is transported through pipelines laid, i.e. stationary, within the floor. This arrangement has a series of disadvantages. On the one hand, pipelines first have to be laid at the installation site, for example in a supermarket. Each refrigerating shelving unit then has to be connected to the pipelines. These pipe connections are a frequent source of faults and lead to leaks from which environmentally harmful, expensive refrigeration agent, which has to be constantly replaced in order for the apparatus to run, can exit. On the other hand, it is a considerable disadvantage that the operation of the whole arrangement of all the refrigerating shelving units fails if the central coldness supply device or even only a single refrigerating shelving unit fails.

In FR 2672114 A1 a refrigeration system is described which generates coldness centrally and feeds the refrigeration agent via lines to the individual refrigerating shelving units. The condenser (11) of the refrigeration system is disposed outside the refrigerating shelving unit on an upper cover.

From US 2004/0031280 A1 a refrigerating shelving unit is known in which a compressor (42) and a condenser (44) are disposed outside the refrigerating shelving unit on an upper cover and an evaporator (40) is disposed in the lower horizontal function chamber.

The arrangement of the compressor and of the condenser outside the actual refrigerating shelving unit requires particular effort during packaging at the manufacturing site and leads to the packaged refrigerating shelving unit being comparatively large in volume. This leads to increased transportation costs for transportation from the manufacturing site to the usage site.

Furthermore, this arrangement of the compressor and of the condenser leads to them becoming soiled. An accumulation of dust on the outside of the compressor has an insulating effect with respect to the external air and causes a deterioration in heat discharge to the surroundings. This in turn means that the compressor heats up more and therefore consumes more energy. The said soiling must be continuously removed for hygiene reasons during ongoing operation and also prior to maintenance work, which leads to additional work and corresponding costs.

Moreover, noise and vibrations are emitted both when switching on and switching off the compressor but also during ongoing operation and these are found to be disturbing by users.

Finally, arranging the compressor and condenser in the upper external region of the refrigerating shelving unit increases the construction height of the refrigerating shelving unit.

On the basis of this prior art, the object of the invention is to create refrigerating furniture, in particular a refrigerating shelving unit of the type mentioned in the introduction with improved properties.

This object is achieved by a refrigerating shelving unit which is defined in the claims.

An advantageous embodiment of the refrigerating shelving unit in accordance with the invention is characterised in that the condenser is disposed at least partially within the upper region of the refrigerating shelving unit, and that the compressor is disposed within the lower region of the refrigerating shelving unit.

The invention is associated with a number of advantages.

The arrangement of the compressor within the lower region of the refrigerating shelving unit, and of the condenser at the top at least partially within the refrigerating shelving unit facilitates packaging and transportation of the refrigerating shelving unit, since no particular effort is required during packaging at the manufacturing site, and leads to the packaged refrigerating shelving unit being of a comparatively small volume. There are therefore no increased transportation costs for transportation from the manufacturing site to the usage site.

Furthermore, this arrangement of the compressor and of the condenser means that there is no soiling. No accumulation of dust arises on the outside of the compressor and therefore there is also no insulation with respect to the external air. The heat discharge from the compressor to the surroundings is not influenced so that the energy consumption of the compressor is optimised. There is no need for cleaning work, whereby the advantage is achieved that additional work and corresponding costs do not arise.

Advantageous embodiments of the refrigerating shelving unit in accordance with the invention are characterised in that on the one hand the condenser is thermally and/or acoustically insulated with respect to the refrigerating chamber and/or that on the other hand the compressor is thermally and/or acoustically insulated with respect to the refrigerating chamber. The advantages of improved efficiency and a reduction in disturbing noise and vibration emissions are therefore achieved.

Further advantageous embodiments of the refrigerating shelving unit in accordance with the invention are characterised in that on the one hand the condenser is accessible from outside the refrigerating shelving unit and/or that on the other hand the compressor is accessible from outside the refrigerating furniture. Maintenance work can therefore be carried out at the usage site without the refrigerating shelving unit having to be moved from its location.

By arranging the condenser in an upper sub-chamber of the refrigerating furniture, maintenance work on the refrigerating shelving unit-specific refrigerating devices can be carried out from the front without goods (refrigerated goods) necessarily having to be unloaded from the refrigerating chamber. The maintenance work can be carried out by a fitter without him requiring auxiliary personnel for the preliminary work (unloading of refrigerated goods etc) or without him having to carry out this work himself.

By arranging the compressor in the refrigerating chamber in accordance with the invention, it is possible to carry out maintenance work easily from the front.

For this purpose, air outlet elements are released or decoupled from the refrigerating shelving unit; the now exposed compressor housing can therefore be released from the outer wall of the housing and be removed so that the work can be carried out directly on the refrigerating system and on the compressor without removing this from the refrigerating shelving unit.

A further advantageous embodiment of the refrigerating shelving unit in accordance with the invention is characterised in that the condenser is disposed in a condenser compartment. This achieves the advantage that the condenser in the condenser compartment is protected against damage and, in addition, the dimensions of the refrigerating shelving unit are optimised. This facilitates the packaging and transportation of the refrigerating shelving unit and leads to the packaged refrigerating shelving unit having a comparatively small volume. There are therefore no increased transportation cost for transportation from the manufacturing site to the usage site.

A further advantageous embodiment of the refrigerating shelving unit in accordance with the invention is characterised in that the condenser compartment is designed to be releasably connected to the refrigerating furniture. In this way, the advantage is achieved that during maintenance the condenser compartment as a whole with the condenser, filter element, shut-off member, pressure sensor and controller/control element with the respective piping can easily be removed.

A further advantageous embodiment of the refrigerating shelving unit in accordance with the invention is characterised in that the compressor is allocated a compressor housing disposed in the refrigerating furniture. In this way, the advantage is achieved that the refrigerating chamber of the refrigerating shelving unit is optimised thermally and acoustically; in particular a perceptible reduction in disturbing noise and vibration emissions is achieved.

A further advantageous embodiment of the refrigerating furniture in accordance with the invention is characterised in that the compressor housing is releasably connected to the refrigerating furniture. The advantage is thereby achieved that the compressor housing can be released and therefore direct maintenance work on the compressor or on the piping can be carried out without having to remove the compressor from the refrigerating shelving unit.

This advantage is also achieved in the case of a further advantageous embodiment of the refrigerating furniture in accordance with the invention which is characterised in that the compressor is accessible via the refrigerating chamber.

A further advantageous embodiment of the refrigerating shelving unit in accordance with the invention is characterised in that the refrigerating shelving unit has a rear wall, and that the rear wall has at least one air outlet element in the region of the compressor. The advantage is thereby achieved that the compressor is cooled by a natural exchange of air with the external air.

A further advantageous embodiment of the refrigerating shelving unit in accordance with the invention is characterised in that the compressor is allocated a ("third") blower device for cooling thereof. In this way, the advantage is achieved that the compressor is cooled by the external air drawn into the compressor compartment by the third blower device. Heating is thereby prevented which would reduce both the efficiency of the refrigerating operation and also the service life of the compressor.

A further advantageous embodiment of the refrigerating shelving unit in accordance with the invention is characterised in that a controller is disposed in the condenser compartment and controls a secondary circuit medium (e.g. brine) fed through the condenser. In this way, the efficiency of the heat exchange is improved.

A further advantageous embodiment of the refrigerating shelving unit in accordance with the invention is characterised in that a controller is disposed in a housing module and that the housing module can be releasably connected to the refrigerating shelving unit. In this way, the advantage is achieved that during maintenance the controller can easily be exchanged and the actual control circuit is protected against soiling.

A further advantageous embodiment of the refrigerating shelving unit in accordance with the invention is characterised in that the condenser compartment is allocated a first insulating medium which consists of an insulating material, preferably based on synthetic rubber, and/or of a similar insulating material. In this way, the advantage is achieved that the condenser compartment is thermally insulated with respect to the cooled air.

A further advantageous embodiment of the refrigerating shelving unit in accordance with the invention is characterised in that the compressor, in particular the compressor housing, is allocated a second insulating medium which is also preferably based on synthetic rubber and/or consists of a similar insulating material. In this way, the advantage is achieved that the compressor is thermally and acoustically insulated with respect to the refrigerating chamber.

A further advantageous embodiment of the refrigerating shelving unit in accordance with the invention is characterised in that the refrigerating shelving unit and an at least one further refrigerating shelving unit each have a refrigerating shelving unit-specific refrigerating device, and that the refrigerating shelving unit-specific refrigerating devices have lines with which the refrigerating shelving unit-specific refrigerating devices can be connected to each other and/or to at least one heat exchanger and in which media at different temperatures are transported.

A number of advantages are thereby achieved.

On the one hand, no pipelines have to be laid at the installation site. On the other hand, the operation of an arrangement of two or more refrigerating shelving units in accordance with the invention does not fail even if a single refrigerating shelving unit of the arrangement should fail, all other refrigerating shelving units continue to operate in an unrestricted manner. Each individual refrigerating shelving unit contains a complete, fully thermal refrigeration system and is therefore independent of other refrigerating shelving units in the assemblage.

A central coldness supply device and therefore piping used in refrigeration technology from such a central device to the individual refrigerating shelving units of the arrangement are omitted.

At the installation site, the refrigerating shelving unit in accordance with the invention merely has to be connected to a mains electricity connection, and lines disposed on the refrigerating shelving unit, which serve to transport one or two different cooling agent media, are to be connected to corresponding pipelines of another item of refrigerating shelving unit and of the heat exchanger or to the lines of two adjoining items of refrigerating shelving unit.

This installation (insertion of a plug into a socket; screwing of pipelines) can be carried out by people without specialist technical knowledge, an expert in refrigeration technology is not required for this purpose which means that the "plug-in" refrigerating shelving unit in accordance with the invention can also be characterised by comparatively low installation costs.

A further advantageous embodiment of the refrigerating shelving unit in accordance with the invention is characterised in that the refrigerating shelving unit and the further refrigerating shelving unit are connected to precisely one common heat exchanger. The advantage is thereby achieved that only one heat exchanger is provided for an arrangement of two or more refrigerating shelving units in accordance with the invention.

A further advantageous embodiment of the refrigerating shelving unit in accordance with the invention is characterised by the advantage of a modular design: the refrigerating shelving unit in accordance with the invention can be integrated both in an arrangement with only one refrigerating shelving unit and also in an arrangement with a plurality of refrigerating shelving units, wherein a single refrigerating shelving unit is either attached to a heat exchanger directly or is attached to the heat exchanger indirectly via a further refrigerating shelving unit or via a plurality of refrigerating shelving units.

The modular design makes it possible to change the arrangement easily. For example, within the scope of the heat exchange capacity, additional refrigerating shelving units can be integrated into the arrangement; individual refrigerating shelving units can be replaced, finally, for example, in times of low demand, individual refrigerating shelving units can even be removed or deactivated.

The line connections are preferably identical, therefore refrigerating modules with identical connections are produced which can be easily connected to each other to form an overall arrangement.

A further advantageous embodiment of the refrigerating shelving unit in accordance with the invention is characterised in that the refrigerating shelving unit and the further refrigerating shelving unit are connected to a common-central-heat exchanger and/or to an apparatus (HZ) which discharges heat to the surroundings.

The heat produced in the refrigerating shelving unit or in the refrigerating device can therefore be used in different ways: with the apparatus mentioned above, it is possible to raise the ambient temperature at the installation site in a controlled manner if required.

Preferred embodiments of the refrigerating shelving unit in accordance with the invention are now described further with reference to the drawing.

Figure 2:
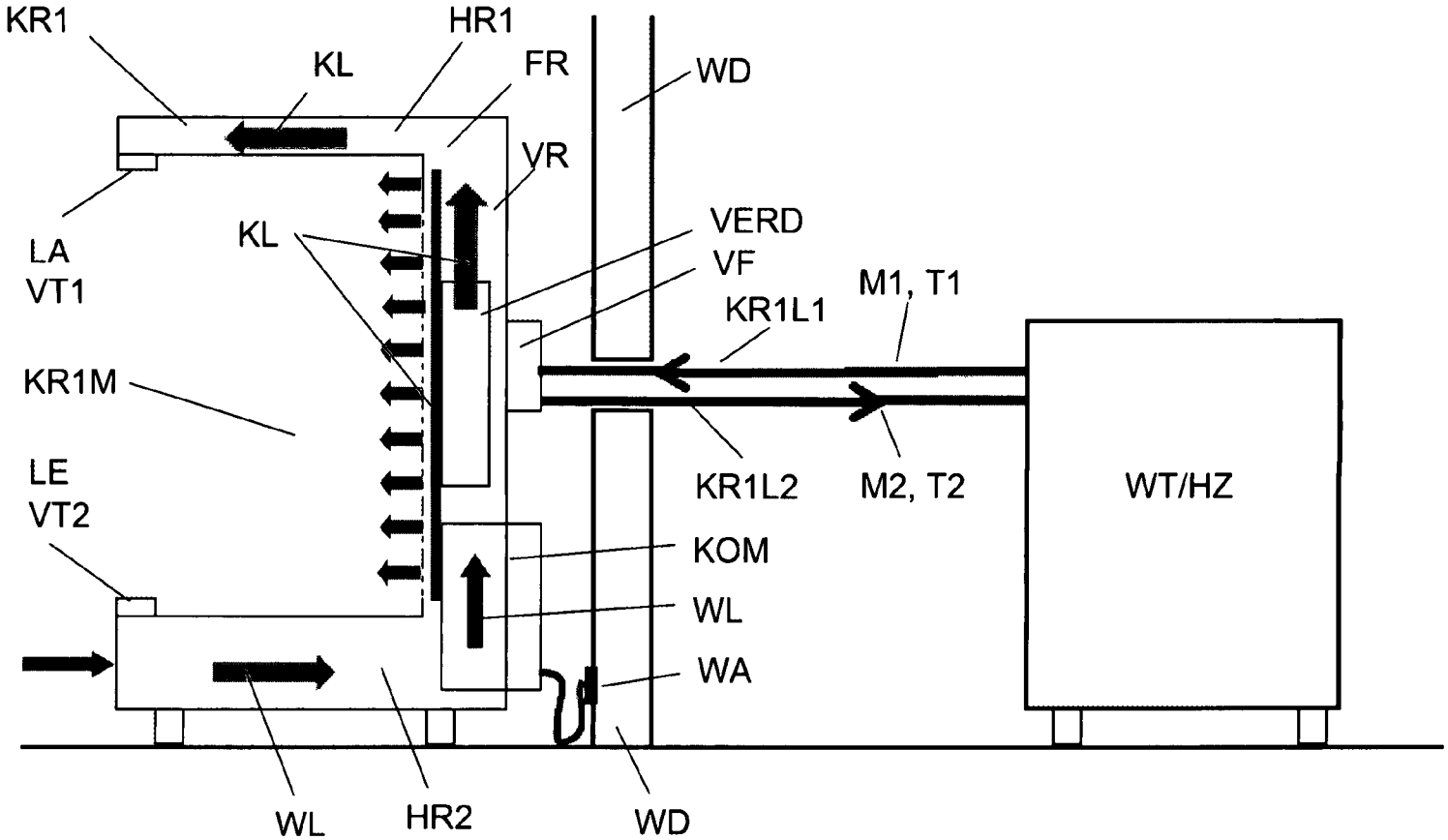
Figure 3:
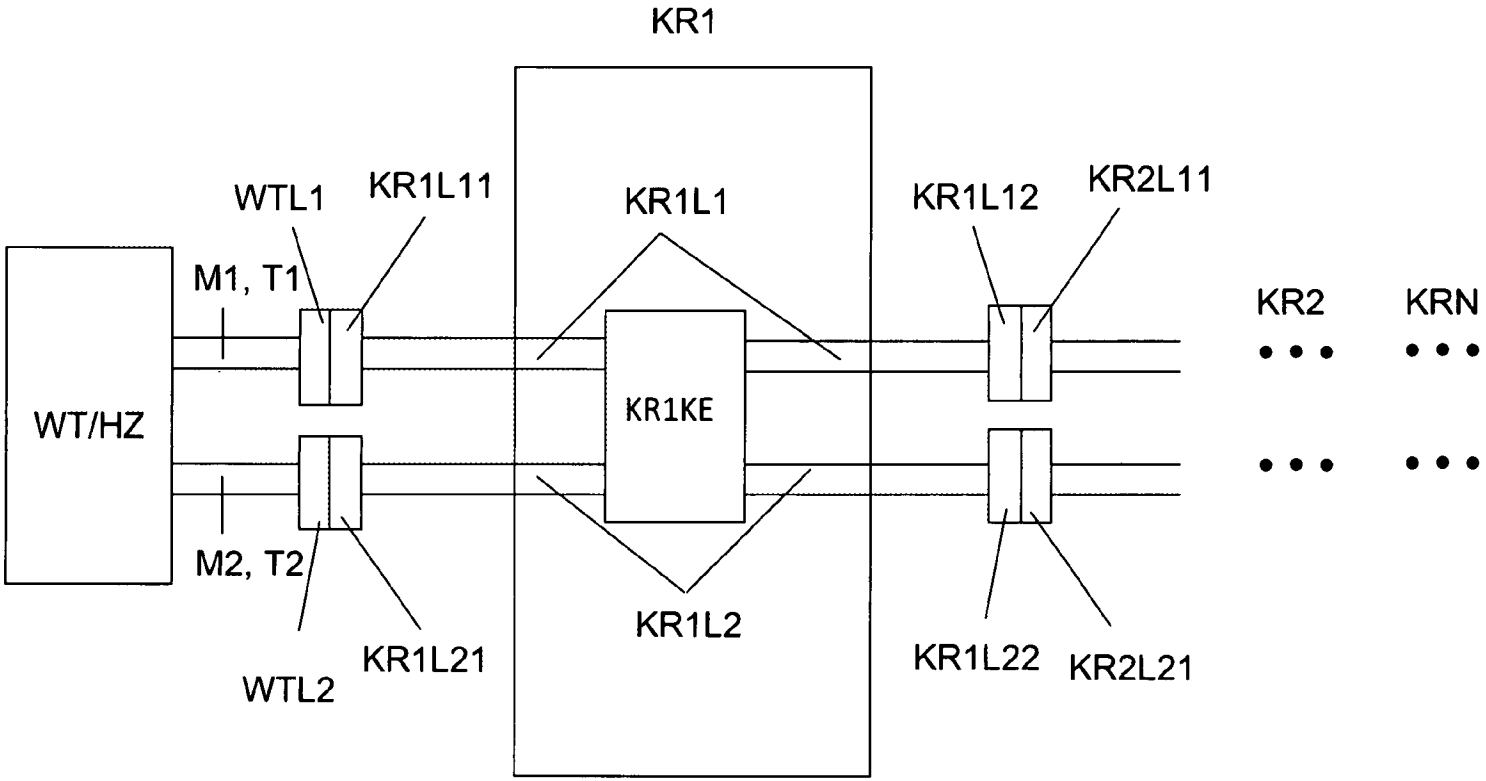
Figure 4:
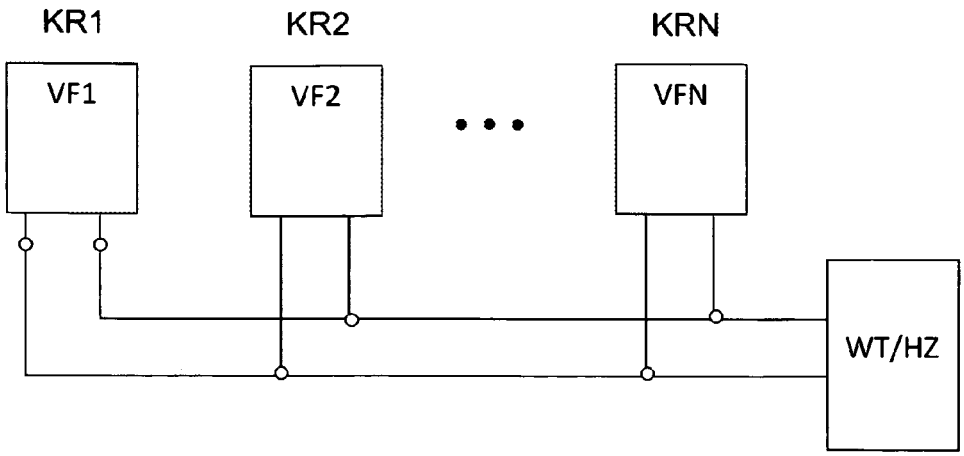

In the drawings:

FIG. 1 shows a perspective view of a refrigerating shelving unit in accordance with the invention, FIG. 2 shows the refrigerating shelving unit of FIG. 1 with components and their interaction, FIG. 3 shows a first, serial arrangement of a plurality of refrigerating shelving units of FIG. 1, and FIG. 4 shows a second, parallel arrangement of a plurality of refrigerating shelving units of FIG. 1.

Figure 5:
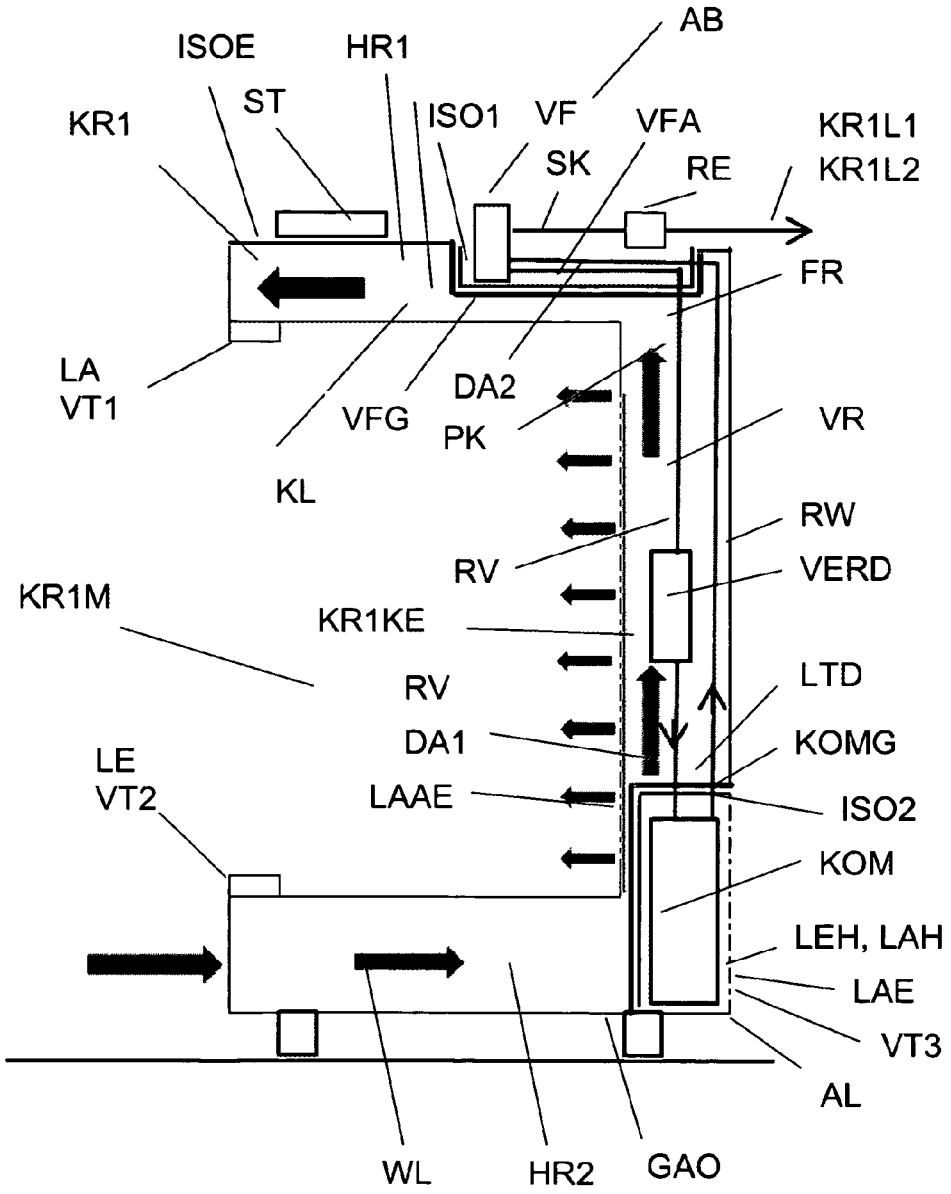
Figure 6:
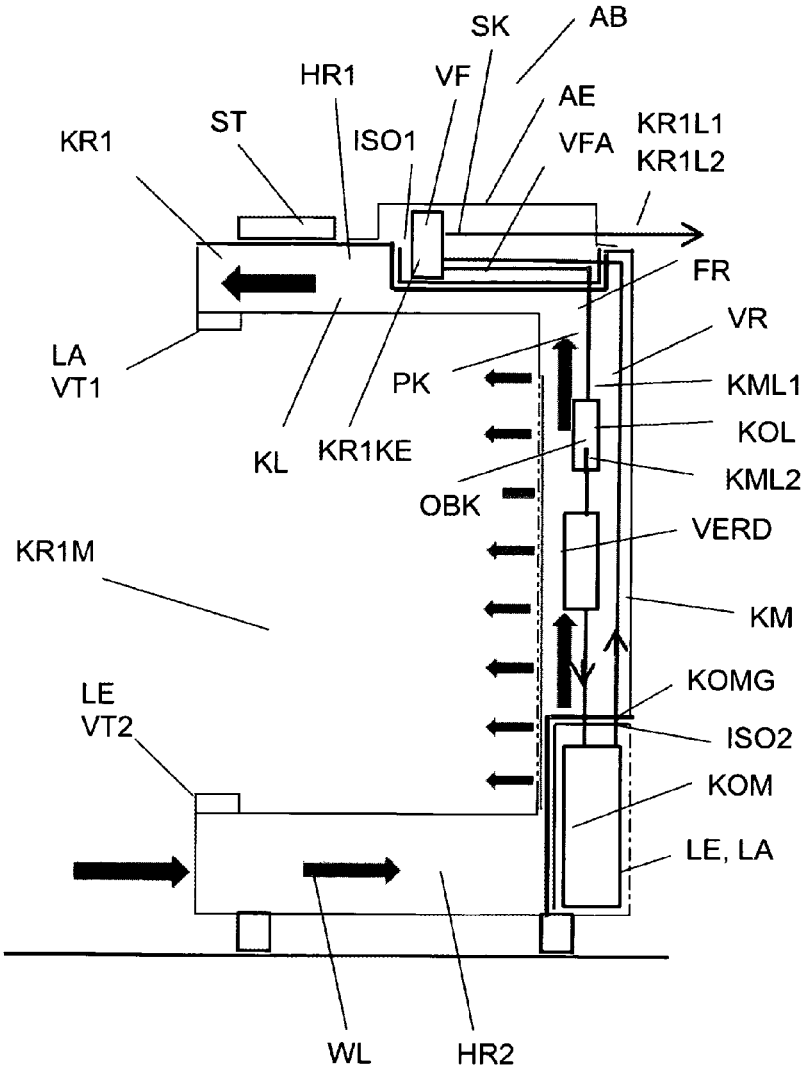
Figure 7:
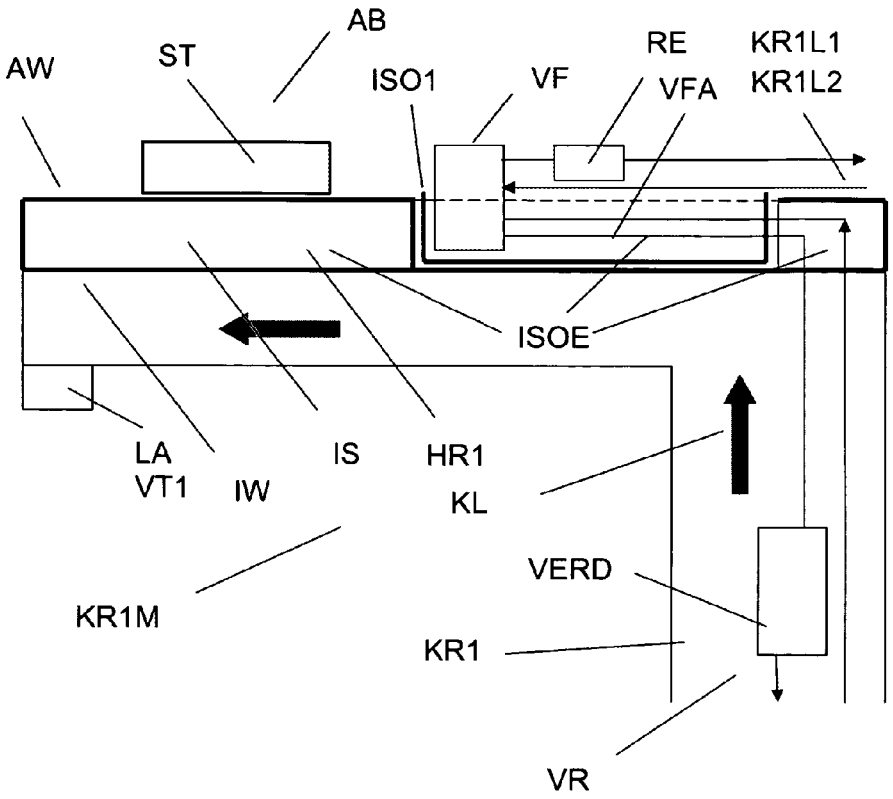
Figure 8:
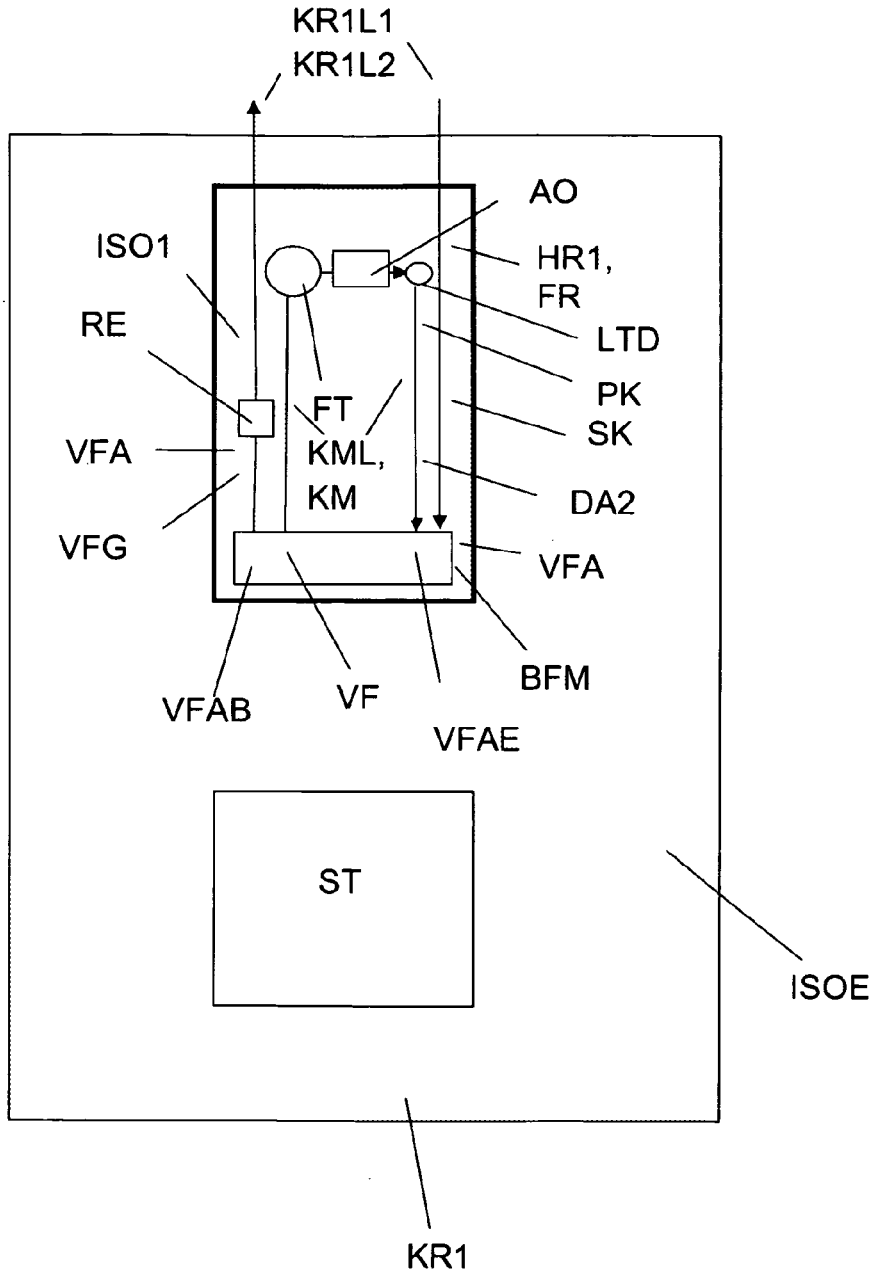

FIG. 5 shows the refrigerating shelving unit of FIG. 1 with an additional condenser compartment, FIG. 6 shows the refrigerating shelving unit of FIG. 1 with an additional condenser compartment and a covering element, FIG. 7 shows the refrigerating shelving unit KR1 as a detail of FIG. 5 with the cross-section of the upper region, and FIG. 8 shows a plan view of the refrigerating shelving unit of FIG. 1 with a controller and a compressor compartment.

FIG. 1 shows a perspective view of an exemplified embodiment of a refrigerating shelving unit KR1 in accordance with the invention. The refrigerating shelving unit KR1 is substantially cuboidal; it is formed open on one side, the front side, while on its rear side, on its lower side, on its upper side and on its left and right sides it is closed. On its right side a vertical side wall element, shown dark in FIG. 1, is illustrated, which is formed in a releasable manner. During refrigerating operation the refrigerating shelving unit is open on at least one side; the refrigerated goods are therefore freely accessible during refrigerating operation. The refrigerating shelving unit can be formed with at least one releasable side wall element and/or with at least one releasable front side wall element.

For the storage of refrigerated goods (in particular perishable goods such as foods, cosmetics, medicines) three horizontally placed shelf elements RE1, RE2 and RE3 as well as the surface RE4 on the floor of the refrigerating shelving unit are provided in a refrigerating chamber (goods-receiving space) KR1M in the example illustrated in FIG. 1. The surface RE4 is located at approximately the same level as the (lower) loading edge LK. The loading edge LK is advantageously located only a few centimeters above the standing surface of the refrigerating shelving unit owing to the particular design of the refrigerating shelving unit, which will be described later, and therefore makes it possible to expand, and thus maximise, the refrigerating chamber in the lower region of the refrigerating shelving unit.

Further constructional formations of the refrigerating shelving unit are shown in FIG. 2 and FIG. 3.

FIG. 2 shows an exemplified embodiment of the refrigerating shelving unit KR1 in accordance with the invention, which is connected via two lines KR1L1, KR1L2 (in particular hose lines, possibly pipelines) to an external heat exchanger WT/HZ. Further refrigerating shelving units (KR2, . . . , KRN in FIG. 3) can also be connected to this external central heat exchanger.

In the case of the exemplified embodiment illustrated in FIG. 2 the refrigerating shelving unit KR1 and the heat exchanger WT are located at two different locations which are separated from each other by a room divider or a wall WD. The heat exchanger WT, however, can be disposed in the immediate proximity of the refrigerating shelving unit KR1, for example on its upper side.

The exemplified embodiment, illustrated in cross-section in FIG. 2, of a refrigerating shelving unit KR1 in accordance with the invention has a refrigerating chamber KR1M which is illustrated in FIG. 2 without the shelf elements RE1, RE2 and RE3 illustrated by way of example in FIG. 1.

Between the refrigerating chamber and the rear side of the refrigerating chamber is a chamber ("function or machine chamber") FR. In the case of the exemplified embodiment illustrated in FIG. 2 the function chamber FR has a vertical sub-chamber VR and an upper and a lower horizontal sub-chamber HR1, HR2. The said sub-chambers HR2, VR, HR1 form a channel for cooled air KL and for warmed air WL.

In the lower region of the vertical sub-chamber VR a compressor KOM is disposed and in the upper region of the vertical sub-chamber VR an evaporator VERD is disposed.

Externally on the rear wall of the refrigerating shelving unit KR1 is located a condenser VF which is connected to the heat exchanger WT/HZ via two pipelines KR1L1 and KR1L2. In the pipeline KR1L1 a first medium M1, in particular water with glycol additive, is supplied from the (cool) outlet of the heat exchanger to the condenser VF. In contrast, in the pipeline KR1L2, a second medium M2, which can be the same as the first medium M1, is supplied from the condenser VF to the (heat) inlet of the heat exchanger. The medium M1 is typically at a temperature T1 in the range of about 10° to about 55° Celsius, while the medium M2 is typically at a temperature T2 in the range of about 15° to 60° Celsius.

Line connections of the two lines KR1L1 and KR1L2 and corresponding line connections to corresponding lines of the heat exchanger WT/HZ are shown in FIG. 3.

The compressor KOM is connected to an electrical mains connection NA via an electric cable.

In the wall surface which defines the refrigerating chamber KR1M and the function chamber FR a plurality of openings are provided through which the cooled air KL flows into the refrigerating chamber KR1M. Cooled air KL also flows through the upper horizontal sub-chamber HR2 to an air outlet LA on the front side of the refrigerating shelving unit (left in the cross-sectional illustration in FIG. 2).

On the front side of the refrigerating shelving unit KR1 (left in the cross-sectional illustration in FIG. 2) a first blower device VT1, in particular a fan, which supplies the cooled air KL into the refrigerating chamber KR1M, is located at the air outlet LA. The blower device VT1 forms a cool air curtain between the upper and lower region of the refrigerating shelving unit. This cool air curtain provides thermal insulation of the refrigerating chamber with respect to the ambient air. The cooled air output by the blower device can additionally be deflected in a controlled manner to each region of the refrigerating chamber and in particular to the region provided for storing the refrigerated goods.

Alternatively to the embodiment illustrated in FIG. 2, the first blower device can be disposed in the rear region of the refrigerating shelving unit, in the function chamber FR therein. The blower device can also be disposed below the evaporator VERD and therefore effect compression of the air through the evaporator. If, contrary to the way illustrated in FIG. 2, the blower device is disposed above the evaporator, air is drawn over the evaporator. The conducting device, in particular a metal sheet, which is disposed at least from the upper edge of the evaporator VERD downwards in the direction of the inner chamber to at most the height of the loading edge, causes coldness to descend the rear wall of the refrigerating chamber. The conducting device (metal sheet) separates warm and cooled air. This conducting device also causes air cooled below the evaporator to pass through the slotted rear wall, which is provided with openings or is slotted, into the cooling chamber.

The said cool air curtain provides thermal insulation of the refrigerating chamber with respect to the ambient air. The cooled air output by the first blower device can be deflected in a controlled manner to each region of the refrigerating chamber and in particular to the region provided for storing the refrigerated goods.

On the front side of the refrigerating region KR1 an air inlet LE and a second blower device VT2, in particular a fan, are located in the lower region of the loading edge LK. This fan on the one hand draws in cooled air after its passage through, or after heating in, the refrigerating chamber ("warm air WL"). On the other hand it draws in cooled air which undesirably passes in front of the refrigerating shelving unit in the lower region. The drawn-in air is supplied into the lower sub-chamber HR2 of the function chamber FR and is supplied into the vertical sub-chamber VR of the function chamber FR.

With the second blower device VT2 it is achieved that, at best, a small quantity of cooled air exits the refrigerating chamber and enters the region low down in front of the refrigerating chamber.

In contrast to FIG. 2, the second blower device can also be disposed in the rear region of the refrigerating shelving unit, both in the lower and also in the upper region.

Provision can also be made that the cooled air, after its passage through, or heating in, the refrigerating chamber ("warm air WL") is fed by negative pressure into the air inlet LE; in this respect, the second blower device VT2 becomes superfluous.

As already described in connection with FIG. 1, the loading edge LK is advantageously located only a few centimeters above the standing surface of the refrigerating shelving unit. This is achieved in that no components of the refrigerating shelving unit-specific refrigerating device (evaporator, condenser, compressor) are provided in the lower sub-chamber HR2 below the refrigerating chamber KR1M.

The lower sub-chamber HR2 is only used as a channel for the warmed air WL; in contrast to the embodiment illustrated in FIG. 2, the refrigerating device including the evaporator is disposed outside the refrigerating shelving unit, in particular the refrigerating device (evaporator, condenser, compressor) is disposed at the top on the refrigerating shelving unit or on a non-open side of the refrigerating shelving unit.

The refrigerating chamber is therefore expanded, and thus maximised, in the lower region of the refrigerating shelving unit.

FIG. 3 shows a schematic view of an arrangement of a plurality of refrigerating shelving units KR1, . . . , KRN serially connected to each other and connected to a common (central) heat exchanger WT/HZ. The individual refrigerating shelving units KR1, . . . , KRN can be disposed at the installation site directly next to each other i.e. without intermediate spacing, or alternatively can be disposed with intermediate spacing.

The refrigerating shelving units KR1, . . . , KRN are connected in series: The failure of one refrigerating shelving unit, for example KR4, does not lead to the failure of refrigerating shelving units KR1, KR2, KR3, KR5, . . . , KRN; the lines of a failed refrigerating shelving unit make it possible, even after failure, to continue to transport the media M1, M2 in one direction between the heat exchanger and the refrigerating shelving units which have not failed.

Each refrigerating shelving unit (for example, KR1) has a refrigerating shelving unit-specific refrigerating device (for example KR1KE with evaporator VERD, condenser VF, compressor KOM) which has a first line KR1L1 and a second line KR1L2. At the ends of the lines KR1L1, KR1L2 are line connections KR1L11, KR1L12; KR1L21, KR1L22 which correspond to line connections (WTL1; WTL2; KR2L11; KR2L21) of units (for example WT/HZ, KR2) which are adjacent to the respective refrigerating shelving unit (in this case KR1) in the arrangement. The line connections are in particular formed identically, for example so-called quick couplings.

The refrigerating shelving unit KR1 in accordance with the invention is thus formed in the following manner:

The refrigerating device KR1KE inside the refrigerating shelving unit is connected to a first line KR1L1 for transportation of a first medium M1 which is at a temperature T1 in a first temperature range, and for connection to the heat exchanger WT;

the refrigerating device KR1KE inside the refrigerating shelving unit is further connected to a second line KR1L2 for transportation of a second medium M2 which is at a temperature T2 in a second temperature range, and for connection to the heat exchanger WT;

the first line KR1L1 has a first line connection KR1L11 which corresponds to a line connection WTL1 of the heat exchanger WT and/or to a first line connection KR2L11 of a further refrigerating shelving unit KR2, the first line KR1L1 further has a second line connection KR1L12 which corresponds to a second line connection KR2L12 of the further refrigerating shelving unit KR2, furthermore, the second line KR1L2 has a first line connection KR1L21 which corresponds to a line connection WTL2 of the heat exchanger WT and/or to a first line connection KR2L21 of the further refrigerating shelving unit KR2.

Finally, the second line KR1L2 has a second line connection KR1L22 which corresponds to a second line connection KR2L21 of the further refrigerating shelving unit KR2.

FIG. 4 shows a schematic illustration of an arrangement of a plurality of refrigerating shelving units KR1, . . . , KRN connected to each other in parallel and connected to a common (central) heat exchanger WT/HZ.

In this arrangement the "first" line and the "second" line of the condenser have "only" one line connection, in particular a through-going line which leads to the heat exchanger.

The illustrated refrigerating shelving units KR1, . . . , KRN discharge the heat energy via the parallel-connected condensers VF1, . . . , VFN. In particular, the condensing pressure in the respective cold circuit (primary circuit) is used as a control variable. In the primary circuit the condensing pressure is kept almost constant in dependence upon the medium (brine) temperature. In a secondary circuit, which includes the heat-discharging region of the heat exchanger, energy is given off and the through-flow is controlled by means of a control valve. The control variable in the secondary circuit is again the condensing pressure. The volume flow is controlled in the control valve. The heat energy is exploited via the common (central) heat discharge.

Closing valves are preferably provided on the heat exchanger, which, when the system is being serviced, make it possible to close the heat-discharging region in order to keep the brine medium in the heat exchanger during servicing.

The illustrated parallel circuit is characterised by the advantage that when one item of refrigerating shelving unit fails, the behaviour of the cooling agent flow from or to the heat exchanger is practically unchanged in comparison to the "non-failed" state. In this parallel arrangement—in contrast to the serial arrangement of FIG. 3—the cooling agent does not flow through a plurality of condensers of a plurality of items of refrigerating shelving unit one after another, i.e. not "in series".

A refrigerating shelving unit-specific refrigerating device KR1KE can also be allocated to at least two refrigerating shelving units KR1, KR2 in the arrangements of FIG. 3 and FIG. 4.

FIG. 5 shows an exemplified embodiment of the refrigerating shelving unit KR1 in accordance with the invention in cross-section. It has a condenser compartment VFA in the upper horizontal sub-chamber HR1 and a compressor compartment KOA in the lower vertical sub-chamber VR. The condenser compartment VFA is located at least partially, possibly even entirely, in the upper sub-chamber HR1. In the front upper outer region AB is located the controller ST of the refrigerating shelving unit, wherein this is preferably disposed in a housing module which can be releasably connected to the refrigerating shelving unit. The housing module can therefore be separated from the refrigerating shelving unit during transportation of the refrigerating shelving unit from the manufacturing site to the usage site, wherein it is inserted into the refrigerating shelving unit at the usage site and therefore electrically connected thereto.

In the vertical sub-chamber VR is located, on the one hand, a section of the condenser VF, which at the same time is disposed in the horizontal sub-chamber HR1, and on the other hand, the compressor compartment KOA with a compressor housing KOMG and a second insulating medium ISO2, the associated compressor KOM and at least one air outlet element LAE.

The compressor compartment KOA is located in the lower region of the vertical sub-chamber VR of the refrigerating shelving unit KR1. The compressor compartment KOA consists of the compressor housing KOMG which is connected to a lower housing outer wall GOA and a back rear wall RW of the refrigerating shelving unit. It receives the compressor KOM; the rear wall has at least one air outlet element LAE in the region of the compressor KOM.

The compressor housing KOMG is releasably connected to the refrigerating shelving unit; if this is removed the compressor KOM is accessible from the front via the refrigerating chamber KR1M. The shelf elements RE1 (FIG. 1) and the front air outlet elements LAAE (FIG. 1) are released or decoupled from the refrigerating shelving unit KR1, the exposed compressor housing KOMG is released and removed from the lower housing outer wall GAO and the rear wall RW so that work can be carried out directly on the refrigeration shelving unit and on the compressor without the compressor having to be removed from the refrigerating shelving unit.

Refrigeration agent lines KML lead from the compressor KOM through the compressor housing KOMG via line passages LTD in the direction of the upper evaporator VD and condenser VF. The compressor housing KOMG prevents the thermal exchange between the external air AL and warmed air WL.

The second insulating medium ISO2 insulates the compressor KOM thermally and acoustically with respect to the refrigerating chamber KR1M; it is intended to insulate warmed air WL and external air AL thermally with respect to each other and additionally with respect to the compressor housing KOMG. For example, the second insulating medium ISO2 is applied to the upper and front side, internally to the compressor housing KOMG. For example, the insulating medium ISO2 can consist of at least one self-adhesive foam element and/or of at least one insulating panel.

In a further embodiment, the compressor housing KOMG can be provided, partially or wholly, with an insulating coating on the inside or outside. The compressor housing KOMG and the second insulating medium ISO2 therefore form a constructional unit.

The compressor KOM is attached to the lower housing outer wall GAO. The air outlet element LAE is formed as a covering element with outlet openings, which constitutes the closure of the compressor housing KOMG on the rear wall RW of the refrigerating shelving unit KR1.

In order to cool the compressor KOM, a third blower device VT3 can additionally be disposed inside or outside the refrigerating shelving unit. The refrigerating shelving unit may possibly be formed without the said air outlet element LAE.

The compressor housing KOMG and the second insulating medium ISO2 damp noise emissions from the compressor KOM and direct them backwards in the direction of the rear wall RW (or wall WD in FIG. 2), which leads to a perceptible reduction in the noise propagation in the direction of the user (open access region of the refrigerating shelving unit, on the left in FIG. 5).

The condenser compartment VFA is located at least partially in the upper horizontal sub-chamber HR1. It consists of a condenser housing VFG, the condenser VF, in particular a plate or tube bundle heat exchanger, refrigeration agent lines KML in liquid communication with the evaporator VF, the compressor KOM as a primary circuit referenced as PK.

The condenser VF is in thermal communication with a secondary circuit SK. This includes a first line KR1L1 with a controller RE which feeds the secondary circuit medium (e.g. brine liquid) to the heat exchanger WT/HZ (FIG. 2), and a second line KR1L2 (not shown in FIG. 5, see also the arrow to the right), which returns the secondary circuit medium to the condenser VF.

The condenser compartment VFA and the condenser housing VFG let into the upper horizontal sub-chamber HR1 is formed like the compressor housing KOMG described above and prevents thermal communication between the external air AL and the cooled air KL.

The air supply for cooling the refrigerating chamber KR1M has already been described with the aid of FIG. 2.

The shape of the condenser housing VFG is trough-like in the embodiment illustrated in FIG. 5 but the condenser compartment VFA can also be made in other shapes.

The condenser compartment VFA is incorporated, for example, into an existing insulating element ISOE, in particular a sandwich plate with a first insulating medium ISO1, as will be described later with the aid of FIG. 7. It can be designed as an independent condenser housing VFG, in particular from a trough bent out of steel plate, which can be integrated or incorporated into an insulating element ISOE.

In particular, the whole insulating element ISOE with the condenser compartment VFA can be produced as one component. The first insulating medium ISO1, which is disposed in the condenser compartment VFA, is integrated in the component and does not have to be additionally incorporated.

The controller ST of the refrigerating shelving unit communicates with the refrigerating shelving unit-specific refrigerating devices KR1KE in the primary circuit PK, in particular the compressor KOM, of a first blower device VT1, the control valve RV, controller RE and the pressure sensor DA2 which measures the condensing pressure, and the pressure sensor DA1 is disposed in the intake region of the compressor KOM and measures the pressure at the intake pipe.

The controller RE disposed in the secondary circuit SK downstream of the condenser VF controls the through-flow of the so-called secondary circuit medium, which is in particular a brine, through the condenser VF. The control of the controller RE is effected via the condensing pressure in the primary circuit PK. The controller RE can be controlled mechanically or electrically via the pressure sensor DA2 and the controller ST and leads via the first line KR1L1 to the heat exchanger WT/HZ (FIG. 2) and via the second line KR1L2 back to the condenser VF.

The exemplified embodiment illustrated in FIG. 6 is a variation of the first refrigerating shelving unit KR1 of FIG. 5. In contrast to the embodiment of FIG. 5, the condenser compartment VFA is protected against dust and soiling by a cover element AE. The condenser VF and other refrigerating shelving unit-specific refrigerating devices KR1KE are also at least partially disposed in the upper horizontal sub-chamber HR1 and protected by the covering element AE. The covering element AE is, in particular, a covering hood made from one or more parts and in various shapes and is formed such that it has a covering surface which is larger than the surface of the condenser compartment VFA. In particular, it can be releasably attached by screws to the first insulating element ISO1.

The covering element AE can also simultaneously cover the controller ST; alternatively a further covering element, not shown in FIG. 6, can be provided and exclusively covers the controller ST. The covering element AE has, for example, additional openings which permit an exchange of air between the condenser compartment VFA and the outer region AB.

The condenser VF is formed, for example, as a plate heat exchanger. A collector KOL is additionally incorporated in the primary circuit PK. The refrigeration agent travels from the upper horizontal sub-chamber HR1 to the collector KOL. This collector KOL is formed as a container with openings at the top and bottom which are connected to the refrigeration agent lines KML1 and KML2. The collector KOL is connected via an upper opening to the refrigeration agent line KML1 and from below to a refrigeration agent line KML2 which protrudes into the collector KOL.

This collector KOL is subjected to the refrigeration agent KM and retains the refrigeration agent KM as a type of buffer until this reaches the level of the upper edge OBK of the refrigeration agent line KML2 protruding into the collector KOL. The upper edge OBK of the lower refrigeration agent line KML2 causes an overflow of the refrigeration agent and thus continuous feeding of liquid refrigeration agent KM to the evaporator VERD.

The exemplified embodiment illustrated in FIG. 7 shows a further variation of the refrigerating shelving unit KR1 illustrated in FIG. 5 as a detail with the cross-section through the upper region of the refrigerating shelving unit KR1. The upper horizontal sub-chamber HR1 is subdivided into a lower region which supplies cooled air KL and discharges this air at the air outlet opening LA to the goods chamber KR1M, and the region lying thereabove which contains the insulating element ISOE with the integrated condenser compartment VFA.

In this variation, a simplified embodiment of the insulating element ISOE with the integrated condenser compartment VFA is shown in the upper horizontal sub-chamber HR1. The insulating element ISOE is designed as a so-called sandwich plate and is described in the further embodiments.

The air supply of cooled air KL is described in more detail in relation to FIG. 2. In this embodiment of the condenser compartment VFA, in particular conventional sandwich plates with thicknesses of at least 4 cm are used. These sandwich plates, which consist of an outer wall AW and an inner wall IW of bending-resistant material such as, in particular, steel plate, wood, synthetic material or composite materials and an insulating material IS, in particular polyurethane, lying therebetween. In the region of the condenser compartment VFA, the outer wall AW and the insulating material IS are removed from the insulating element ISOE until in this region only the inner wall IW remains. This inner wall IW serves as an attachment for the refrigerating shelving unit-specific refrigerating devices KR1KE. In this condenser compartment VFA thus produced, in particular on the sides and on the floor, an insulating medium ISO1 is inserted as already described with the aid of FIG. 5 in conjunction with the compressor housing KOMG in the case of the second insulating medium IS 02.

In a further embodiment, not shown, of FIG. 7 the controller ST is at least partially lowered into the upper horizontal sub-chamber HR1.

FIG. 8 shows an exemplified embodiment of the refrigerating shelving unit KR1 in accordance with the invention in the form of a plan view. FIG. 8 shows the insulating element ISOE with the controller ST and a condenser compartment VFA embedded into the insulating element ISOE. The construction of the condenser housing VFG and of the first insulating medium ISO1 corresponds to the embodiment of FIG. 5. The refrigerating shelving unit-specific refrigerating devices KR1KE disposed in the condenser compartment VFA are in the primary circuit PK, the second pressure sensor DA2, the condenser VF, the filter element FT and the shut-off member AO.

The refrigeration agent lines KML of the primary circuit PK are passed through line passages LTD into the vertical sub-chamber VR and connected to further refrigerating shelving unit-specific refrigerating devices KR1KE. The complete primary circuit PK of the cold circuit is already shown in FIG. 5 and FIG. 6.

The condenser consists of a respective condenser inlet VFAE and a condenser outlet VFAB. The condenser VF can lie on the condenser housing VFG or be fixed by fastening means BFM to the condenser housing VFG. From the condenser outlet VFAB the refrigeration agent KM flows through a filter element FT, in particular a filter dryer which binds water and solids from the refrigeration agent KM and flows further through a shut-off member AO which automatically closes in the event of deactivation or failure of the compressor KOM and thus prevents liquid refrigeration agent KM passing through the evaporator VERD into the intake region of the compressor KOM and causing damage to the compressor KOM upon renewed start-up, so-called liquid slugging. The secondary circuit SK of FIG. 8 corresponds to the secondary circuit of FIG. 5.

In the refrigerating shelving unit in accordance with the invention, the condenser VF is disposed at least partially within the upper region HR1 of the refrigerating shelving unit KR1, and the compressor KOM is disposed within the lower region VR of the refrigerating shelving unit KR1. The condenser VF is thermally and/or acoustically insulated with respect to the refrigerating chamber KR1M; similarly the compressor KOM is thermally and/or acoustically insulated with respect to the refrigerating chamber KR1M.

The condenser VF is accessible from outside the refrigerating shelving unit; similarly the compressor KOM is accessible from outside the refrigerating shelving unit.

The condenser VF is disposed in a condenser compartment VFA which is preferably designed to be releasably connected to the refrigerating shelving unit.

The compressor KOM is allocated a compressor housing KOMG which is disposed in the refrigerating shelving unit and which is preferably releasably connected to the refrigerating shelving unit. The compressor KOM is accessible via the refrigerating chamber KR1M.

The furniture refrigerating shelving unit has a rear wall RW which has at least one air outlet element LAE in the region of the compressor KOM.

The compressor KOM is allocated a third blower device VT3 for cooling thereof.

A controller RE is disposed in the condenser compartment VFA and controls a secondary circuit medium SK passed through the condenser VF.

A refrigerating shelving unit controller ST in a housing module is disposed to the refrigerating shelving unit and this housing module can be releasably connected to the refrigerating shelving unit.

The condenser compartment VFA is allocated a first insulating medium ISO1 which consists of insulating material based in particular on synthetic rubber and/or of similar insulating material. The compressor housing KOMG is allocated a second insulating medium ISO2 which consists of insulating material based in particular on synthetic rubber and/or of similar insulating material.

REFERENCE LIST

KE1 refrigerating device inside the refrigerating shelving unit
WT heat exchanger
WTL1, WTL2 first and second line from WT
HZ apparatus, heating
M1 first medium
M2 second medium
T1 temperature in a first temperature range
T2 temperature in a second temperature range
KR1 (first) refrigerating shelving unit
KR1M refrigerating chamber of KR1
RE1, . . . , RE4 horizontal shelf element
LK lower loading edge
FR function chamber
VR vertical sub-chamber
HR1 upper horizontal sub-chamber
HR2 lower horizontal sub-chamber
KR1KE refrigerating shelving unit-specific refrigerating device of KR1
KOM compressor
VERD evaporator
VF condenser
KR1L1 first line from KR1
KR1L11 first line connection from KR1L1
KR1L12 second line connection from KR1L1
KR1L2 second line from KR1
KR1L21 first line connection from KR1L2
KR1L22 second line connection from KR1L2
VT1 first blower device, fan
VT2 second blower device, fan
NA mains connection
WD wall
KL cooled air
WL warmed air
LA air outlet
LE air inlet
KR2 further (second) refrigerating shelving unit
KR2M refrigerating chamber of KR2
KR2KE refrigerating shelving unit-specific refrigerating device of KR2
KR2KEVF condenser of KR2KE
KR2L1 first line from KR2
KR2L11 first line connection from KR2L1
KR2L12 second line connection from KR2L1
KR2L2 second line from KR2
KR2L21 first line connection from KR2L2
KR2L22 second line connection from KR2L2
KRN $n^{th}$ refrigerating shelving unit
VT3 third blower device, fan
KOMG compressor housing VFA condenser compartment
ISO1 first insulating medium
ISO2 second insulating medium
ISOE insulating element
LAH rear air outlet
LEH rear air inlet
LAE rear air outlet element
ST control
AE covering element
RE controller
AO shut-off member
KOL collector
LTD line passages
FT filter element
IW inner wall
AW outer wall
IS insulating element
AB outer region
UG surroundings
DA1 pressure sensor 1
DA2 pressure sensor 2
KML cooling agent lines
GAO housing outer wall
VFG condenser housing
AL external air
RV control valve
RW rear wall
PK primary circuit
SK secondary circuit (medium)
AB outer region
UG surroundings
VFAE condenser inlet
VFAB condenser outlet
KM refrigeration agent
BFM fastening means
LAAE front air outlet element
KML1 first refrigeration agent line
KML2 second refrigeration agent line
OBK upper edge
KOA compressor compartment

The invention claimed is:

1. A refrigerating shelving unit comprising:
a refrigerating chamber (KR1M);
an access region via which refrigerated goods are accessible;
a refrigerating device (KR1KE) including:
a condenser (VF) located at least partially within the upper region (HR1) of the refrigerating shelving unit (KR1) in a separate insulated condenser compartment (VFA) which is configured to be releasably connected to the refrigerating shelving unit and is accessible from outside the refrigerating shelving unit;
a vertical sub-chamber, an upper horizontal sub-chamber, and a lower horizontal sub-chamber with a compressor located within a compressor housing (KOMG) in the vertical sub-chamber;
a rear wall (RW) with at least one air outlet adjacent to the compressor (KOM);
the compressor (KOM) is connected to the rear wall (RW) of the refrigerating shelving unit; the rear wall has at least one front air outlet element (LAAE) in the region of the compressor (KOM); and
the compressor is configured to be accessible from the outside of the refrigerating shelving unit and also releasably connected to the refrigerating shelving unit after shelf elements (RE1) and the front air outlet elements (LAAE) are released or decoupled from the refrigerating shelving unit.

2. The refrigerating shelving unit as claimed in claim 1, further comprising a refrigerating shelving unit controller (ST) located in a housing module which is releasably connected to the refrigerating shelving unit.

3. The refrigerating shelving unit according to claim 1, in which the condenser (VF) is located in the upper horizontal sub-chamber.

4. The refrigerating shelving unit according to claim 3, characterised in that the condenser compartment (VFA) includes an insulating medium (ISO1), based on synthetic rubber or consisting of another type of insulating material.

5. The refrigerating shelving unit according to claim 3, in which the condenser and the compressor are configured to be removed separately.

6. The refrigerating shelving unit according to claim 1, characterised in that the compressor (KOM) is allocated a blower device (VT3) for cooling the compressor.

7. The refrigerating shelving unit as claimed according to claim 1, characterised in that a control element (RE) is disposed in the condenser compartment (VFA) and controls a through-flow of a cooling agent through the condenser (VF).

8. The refrigerating shelving unit according to claim 1, in which the compressor (KOM) is accessible via the refrigerating chamber (KR1M).

9. The refrigerating shelving unit according to claim 1, characterised in that the compressor (KOM), in particular the compressor housing (KOMG), includes an insulating medium (ISO2), based on synthetic rubber or consisting of another type of insulating material.

10. The refrigerating shelving unit according to claim 1, characterised in that the refrigerating shelving unit (KR1) and at least one further refrigerating shelving unit (KR2) each have a refrigerating shelving unit-specific refrigerating device (KR1KE, KR2KE), and that the refrigerating shelving unit-specific refrigerating devices (KR1KE, KR2KE) have lines (KR1L1, KR1L2; KR2L1, KR2L2) with which the refrigerating shelving unit-specific refrigerating devices can be connected to each other and to at least one heat exchanger (WT) and in which media (M1, M2) at different temperatures (T1, T2) are transported.

11. The refrigerating shelving unit according to claim 10, characterised in that the refrigerating shelving unit (KR1) and the at least one further refrigerating shelving unit (KR2) are connected to precisely one common heat exchanger (WT).

12. The refrigerating shelving unit (KR1) according to claim 10, characterised in that the refrigerating device (KR1KE) inside the refrigerating shelving unit is connected to a first line (KR1L1) for transportation of a first medium (M1) which is at a temperature (T1) in a first temperature range, and for connection to the heat exchanger (WT);
the refrigerating device (KR1KE) inside the refrigerating shelving unit is connected to a second line (KR1L2) for transportation of a second medium (M2) which is at a temperature (T2) in a second temperature range, and for connection to the heat exchanger (WT);
the first line (KR1L1) has a first line connection (KR1L11) which corresponds to a line connection (WTL1) of the heat exchanger (WT) and/or to a first line connection (KR2L11) of the further refrigerating shelving unit (KR2), the first line (KR1L1) has a second line connection (KR1L12) which corresponds to a second line connection (KR2L12) of the further refrigerating shelving unit (KR2), the second line (KRL2) has a first line connection (KR1L21) which corresponds to a line connection (WTL1) of the heat exchanger (WT) and/or to a first line connection (KR2L21) of the further refrigerating shelving unit (KR2), and the second line (KR1L2) has a second line connection (KR1L22) which corresponds to a second line connection (KR2L21) of the further refrigerating shelving unit (KR2).

13. The refrigerating shelving unit according to claim 12, characterised in that the line connections (KR1L11, KR1L12; KR1L21, KR1L22; WTL1, WTL2) are identical.

14. The refrigerating shelving unit according to claim 13, characterised in that the condenser (KR1KEVF; KR2KEVF) of the refrigerating shelving unit-specific refrigerating devices (KR1KE, KR2KE) are connected to the first line (KR1L1, KR2L1) and to the second line (KR1L2, KR2L2).

15. The refrigerating shelving unit according to claim 12, characterised in that the refrigerating shelving unit (KR1) and the at least one further refrigerating shelving unit (KR2) are connected to a common heat exchanger (WT) and/or to an apparatus (HZ) which discharges heat to the surroundings.

16. The refrigerating shelving unit according to claim 12, characterised in that the refrigerating chamber (KR1M), in an access region, has a releasable wall element, in particular a releasable side wall element.

17. The refrigerating shelving unit according to claim 12, characterised in that a refrigerating shelving unit-specific refrigerating device (KR1KE) is allocated to at least two refrigerating shelving units (KR1, KR2).

18. The refrigerating shelving unit according to claim 12, characterised in that the refrigerating chamber (KR1M) is open on at least one side so that the refrigerated goods are freely accessible during refrigerating operation.

19. The refrigerating shelving unit according to claim 1, characterised in that the refrigerating shelving unit (KR1, KR2) has at least one further blower device (VT1, VT2) which is disposed in the upper region of the refrigerating shelving unit (KR1, KR2) and feeds a flow (KL) of cool air, formed by the refrigerating shelving unit-specific refrigerating device, into the refrigerating chamber (KR1M1, KR1M2) of the refrigerating shelving unit (KR1, KR2), and/or which is disposed in particular in the lower region of the refrigerating shelving unit (KR1, KR2), which draws the flow (WL) of cool air out of the refrigerating chamber (KR1M, KR2M) after it has been warmed therein.

* * * * *